US007365493B2

(12) United States Patent
Lee et al.

(10) Patent No.: US 7,365,493 B2
(45) Date of Patent: Apr. 29, 2008

(54) DEVICE FOR PRODUCING HIGH FREQUENCY MICROWAVES

(75) Inventors: Chun Sik Lee, Saarbruecken (DE); Hyeck-Hee Lee, St. Ingbert (DE); Min-Suk Lee, Saarbruecken (DE)

(73) Assignee: Kist Europe Korea Institute of Science and Technology Europe Forschungsgesellschaft mbH, Saarbruecken (DE)

( * ) Notice: Subject to any disclaimer, the term of this patent is extended or adjusted under 35 U.S.C. 154(b) by 928 days.

(21) Appl. No.: 10/469,728

(22) PCT Filed: Mar. 4, 2002

(86) PCT No.: PCT/EP02/02332

§ 371 (c)(1),
(2), (4) Date: Jan. 14, 2004

(87) PCT Pub. No.: WO02/071435

PCT Pub. Date: Sep. 12, 2002

(65) Prior Publication Data

US 2004/0118840 A1 Jun. 24, 2004

(30) Foreign Application Priority Data

Mar. 2, 2001 (DE) ..... 101 11 817

(51) Int. Cl.
*H01J 25/00* (2006.01)

(52) U.S. Cl. ..... 315/5; 315/5.36; 315/5.37; 313/293; 313/311

(58) Field of Classification Search ..... 315/5.36, 315/5.37, 5; 313/45, 311, 293
See application file for complete search history.

(56) References Cited

U.S. PATENT DOCUMENTS

| | | | | |
|---|---|---|---|---|
| 2,410,822 A | | 11/1946 | Kenyon | |
| 4,480,210 A | | 10/1984 | Preist et al. | |
| 4,527,091 A | * | 7/1985 | Preist | 315/5 |
| 5,589,736 A | * | 12/1996 | Lien et al. | 315/5.43 |
| 5,883,367 A | | 3/1999 | Cho et al. | |
| 5,883,368 A | | 3/1999 | Jeong | |
| 5,883,369 A | | 3/1999 | Kim et al. | |
| 5,883,386 A | | 3/1999 | Tsuyuki et al. | |
| 6,297,592 B1 | | 10/2001 | Goren et al. | |

FOREIGN PATENT DOCUMENTS

| | | |
|---|---|---|
| GB | 1 353 547 | 5/1974 |
| GB | 2 287 579 A | 9/1995 |
| GB | 2 333 892 A | 8/1999 |

* cited by examiner

*Primary Examiner*—David Vu
(74) *Attorney, Agent, or Firm*—Marshall & Melhorn, LLC

(57) ABSTRACT

A device is proposed for producing high-frequency microwaves, having a cathode arrangement with heatable cathodes for emitting electrons, two grating arrangements for controlling and focusing the electrons flow and an anode for recaiving the electrons passing through the grating arrangements. The cathode arrangement and the first grating arrangement and also a blocking or choke element define an output cavity forming a resonance cavity and the anode and the second grating arrangement define an output cavity likeeise forming a resonance cavity. The cathode arrangement has a monuting for the cathode such that deformation of the cathode with reduction of the spacing between the heatable cathode and grating is avoided.

19 Claims, 10 Drawing Sheets

A-B

DEVICE FOR PRODUCING HIGH FREQUENCY MICROWAVES

BACKGROUND OF THE INVENTION

The invention relates to a device for producing high-frequency microwaves according to the preamble of the main claim.

A device for producing high-frequency microwaves is disclosed in the U.S. Pat. Nos. 5,883,367, 5,883,369 and 5,883,386. This device has two resonance cavities, an input cavity and an output cavity, the input cavity comprising a cathode for emitting a linear electron beam, a blocking or choke structure for blocking a direct current and for transmitting a weak oscillation and a grating for focusing the electron beam and for modulating the same with respect to its density. The output cavity has a grating and an anode which receives the electron beam or the electrons thereof modulated in density, a microwave oscillation being produced. A feedback bar, by means of which the resonance cavities are coupled to each other, is connected to the input cavity and protrudes into the output cavity, as a result of which a part of the microwave energy is fed back into the input cavity. The microwave energy is directed out of the device by means of an antenna coupled to the output cavity.

SUMMARY OF THE INVENTION

This known device is used essentially for microwave ovens, a cylindrical magnetron being used frequently in microwave ovens as microwave source. The above-described device has the advantage relative to the magnetron that no magnets are required in order to focus electrons. The operating voltage at approximately 500 to 600 volts is lower than in the case of a microwave source with a magnetron and a transformer is not required. The output power can be varied by using a resistor between the grating and the cathode. The electromagnetic noise level of the device is very low since the microwave energy is produced by a linear movement of the electrons.

In the case of the known device, a precise alignment of the components, i.e. of the cathode, two gratings and an anode, is important. The intermediate spacings are in the range of 0.1 to 1 mm which normally does not present a problem in the case of a cold arrangement. However, the temperature of the cathode faces is in the range of 600° C. to 1,000° C. At such high temperatures, it is difficult because of the thermal deformations to maintain the precise alignment, which results in for example a contact between the grating and the cathode but also between the gratings themselves or between the grating and the anode. This is a critical problem for operating the above-mentioned device.

The object therefore underlying the invention is to produce a device for producing high-frequency microwaves, in which electrical short circuits, in particular between cathode and grating, due to thermal deformations, are extensively avoided.

This object is achieved according to the invention by the characterising features of the main claim in conjunction with the features of the preamble. Advantageous developments and improvements are possible due to the measures indicated in the sub-claims.

By means of the precise positioning of at least the first grating arrangement and the cathode arrangement via positioning means and also the provision of a mounting for the cathode, which avoids the deformation of the cathode with reduction of the spacing between the grating arrangement and the cathode arrangement, a thermally stable arrangement is produced which permits small spacings between the cathode and the grating without short circuits.

The mounting comprises a cathode housing, on or in which the cathode is disposed as a part which is separate from the housing with a spacing from the housing wall, as a result of which deformation of the cathode arrangement because of different heat expansion coefficients between the heatable cathode and surrounding housing, is avoided. The mounting comprising the cathode housing holds the cathode if necessary by means of a cathode body whilst maintaining a gap between the parts. The gap serves as a buffer for the expansion due to heat.

The cathode housing insulates' the cathode from the input resonance cavity and is used for an arrangement of the cathode face and of the first grating in the micrometer range. It minimises a radial loss of heat energy from the cathode and reduces radial expansion of the cathode which could influence the dimension of the input resonance cavity.

Preferably, the cathode housing is configured as a cylinder with a flange fixed to the circumferential face of the cylinder, the cathode being disposed in the cylinder with a gap. In this manner, a clear separation between the face emitting electrons and the resonance face is prescribed in the input cavity corresponding to the invention. The grating arrangement comprises advantageously an annular grating holder with spoke-shaped webs, i.e. an inner ring and an outer ring are provided which are connected by spokes, and the grating is supported on the edge and on the webs of the grating holder and is fixed to the latter in a frictional and/or form fit.

The configuration of the cathode as a combination of a cathode body and metal plate emitting electrons minimises thermal deformation due to high operating temperatures.

Advantageously, the cathode housing is an annular blocking or choke element disposed between the cathode housing and the grating holder of the first grating arrangement, and the grating holders of the two grating arrangements are aligned relative to each other by means of alignment pins and fixed in their position relative to each other as a result of which the output cavity is aligned securely above the input cavity and parallel thereto, the electrical insulation between the two cavities being produced by using ceramic spacing elements which screen the alignment pins.

Due to the above arrangement, an optimal design and an optimal arrangement of the components is ensured and thermal deformation, such as sagging of the gratings, is successfully reduced because of the bridges or web structure, short circuits between the components being avoided due to the clean spacing and alignment of the components relative to each other and as a result of which a good focusing of the electron beams is ensured.

BRIEF DESCRIPTION OF THE DRAWINGS

Embodiments of the invention are illustrated in the drawing and are described more fully in the subsequent description. There are shown FIG. 1 a section through the device for producing microwaves according to an embodiment of the present invention, FIG. 2 a section through the lower part of the device according to FIG. 1 with input cavity and output cavity, FIG. 3 an enlarged section through parts of the device according to FIG. 1 and FIG. 2 with input cavity, FIG. 4 a view from below of a cathode housing and a side view of the cathode housing, FIG. 5 a view of a cathode body and a section view and a view of the plate emitting electrons, FIG. 6 an enlarged section illustration of the feedback arrangement, FIG. 7 a view of a blocking or choke element, FIG. 8 a view of and a section through an embodiment of the first grating arrangement, FIG. 9 a view of an embodiment of the second grating arrangement, and FIG. 10 a view of the anode, observed from below.

DESCRIPTION OF THE PREFERRED EMBODIMENTS

Figure 1:
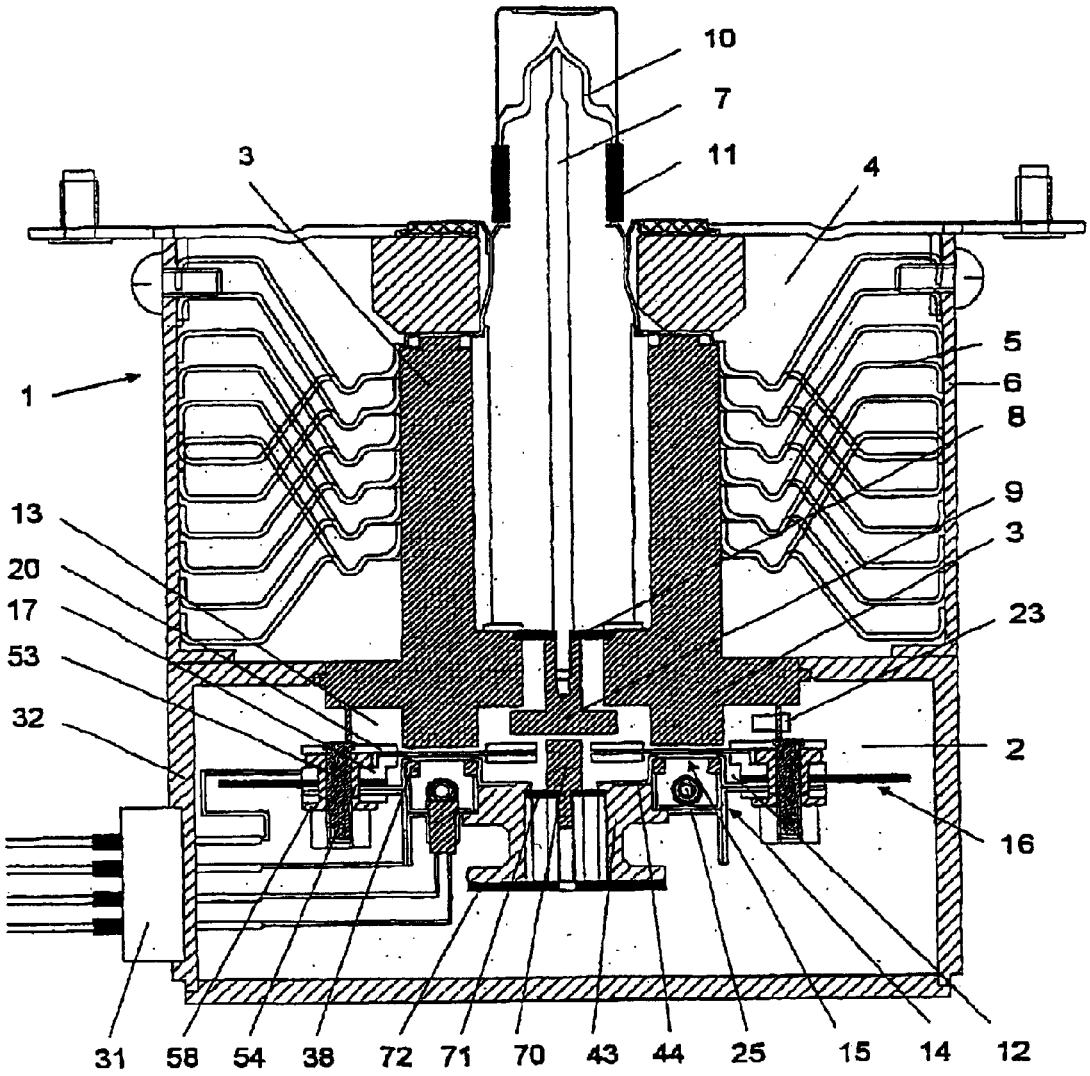
Figure 2:
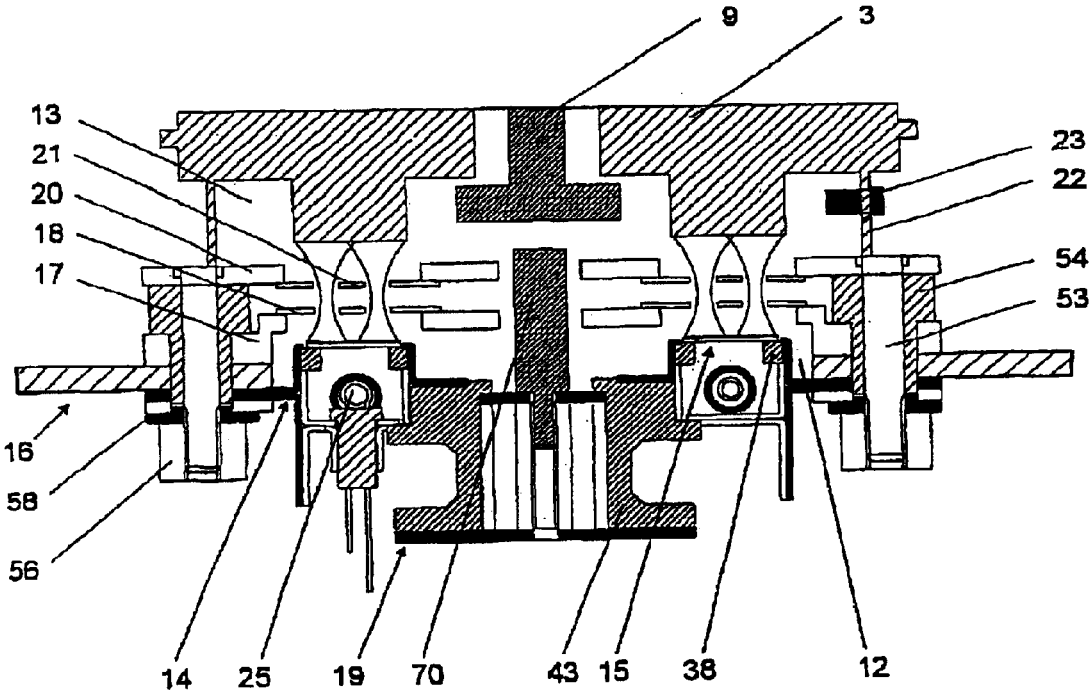

The device 1 illustrated in FIG. 1 has a vacuum chamber 2 surrounded by a housing 32, in which device a cathode arrangement, a grating arrangement and in part an anode arrangement are contained, which can be detected in more detail in FIG. 2. One part of the anode 3 fixed on the housing 32 of the vacuum chamber 2 protrudes into a cooling chamber 4, in which cooling ribs 5 are disposed between the anode 3 and the housing 6 for dissipating the heat from the anode 3. A bar-shaped antenna 7 is aligned centrally relative to the anode 3 and is insulated from the anode 3 by a ceramic disc 8. It terminates on the anode side in a coupling element 9, whilst the other end is contained in a cap 10, a ceramic cylinder 11 insulating the antenna 7 from the remaining housing.

In FIG. 2, the components which are contained in the vacuum chamber 2 are illustrated more precisely. Two resonance chambers or resonance cavities are disposed one above the other and parallel, an input cavity 12 and an output cavity 13. The input cavity 12 configured as an annular chamber is delimited by a ring arrangement which is formed by a cathode housing 14, a blocking or choke arrangement 16 and a grating holder 17. A cathode 15 is inserted in the cathode housing 14 and a grating 18 is disposed on the grating holder 17. A feedback arrangement 19 is provided in the central region within the cathode housing 14. The input cavity 12 is dimensioned to be very narrow in the region between the grating 18 and the cathode 15, i.e. the spacing between the components is approximately in the region of 0.1 mm. Hence the spacings must also be maintained during operation in order that no short circuits occur. In the illustration, the spacing between the grating 18 and the cathode 15 was chosen very much larger, in reality for example the lower face of the grating holder lies in the region of the upper end of the cathode housing 14 and thereunder, as is shown in FIG. 1.

Above the input cavity 12, the output cavity 13 is provided in a parallel arrangement, said output cavity being configured as a toroidal chamber and is delimited by the anode 3, by a grating holder 20 for a grating 21 and also by a wall 22 surrounding the output cavity 13 in an annular form, which wall is a component of the anode 3. The coupling element 9 connected to the antenna 7 protrudes into a central chamber between the anode 3 and the grating holder 20. Furthermore, a tuning pin 23 which serves for changing the resonance frequency in the output cavity 13, engages through the surrounding wall 22.

Figure 3:
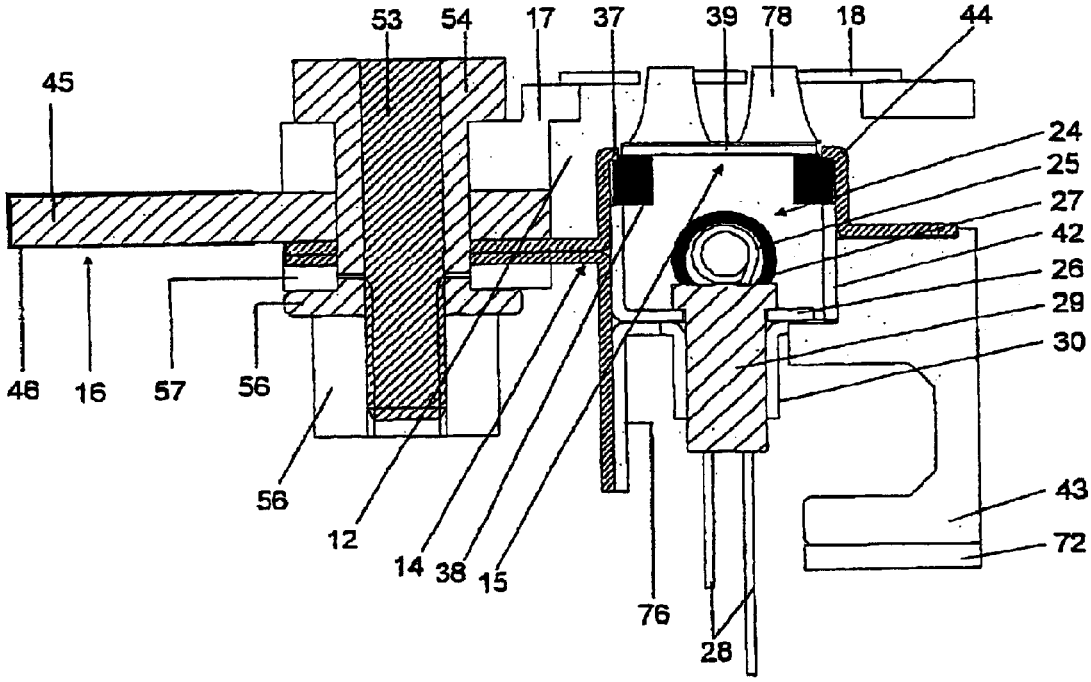

In FIG. 3, the cathode arrangement, which has the cathode housing 14 and the cathode 15, the choke arrangement 16 and the first grating arrangement with grating holder 17 and grating 18, is illustrated in more detail. It should be noted in this respect that, for clarity, the spacing between the cathode 15 and the grating 18 is illustrated very much larger, just as in FIG. 2, than if it were true to scale.

The cathode 15 is configured as a thermoionic cathode, thus a heating device 24 is disposed underneath the cathode 15 and has a helical heating wire 25. The heating device 24 is contained in a cylindrical housing 26 which has a member parallel to the cathode 15, a cylinder 76, which is connected to the cathode housing 14, for example by welding, presses the housing 26 upwardly with the bent-over member. Preferably, the housing 26 and the cylinder 76 are made of tantalum. The helical heating wire 25 is secured to the heating housing 26 via ceramic rings 27, the electrical connections 28 for the heating wire 25 being produced by means of a ceramic duct 29 with two borings. The heating housing 26 has in the region of the duct 29 a cylinder extension 30 which supports the duct 29. The electrical connections 28 are connected to a plug 31 which is secured to the housing 32 surrounding the vacuum chamber 2 (see FIG. 1).

Figure 4:
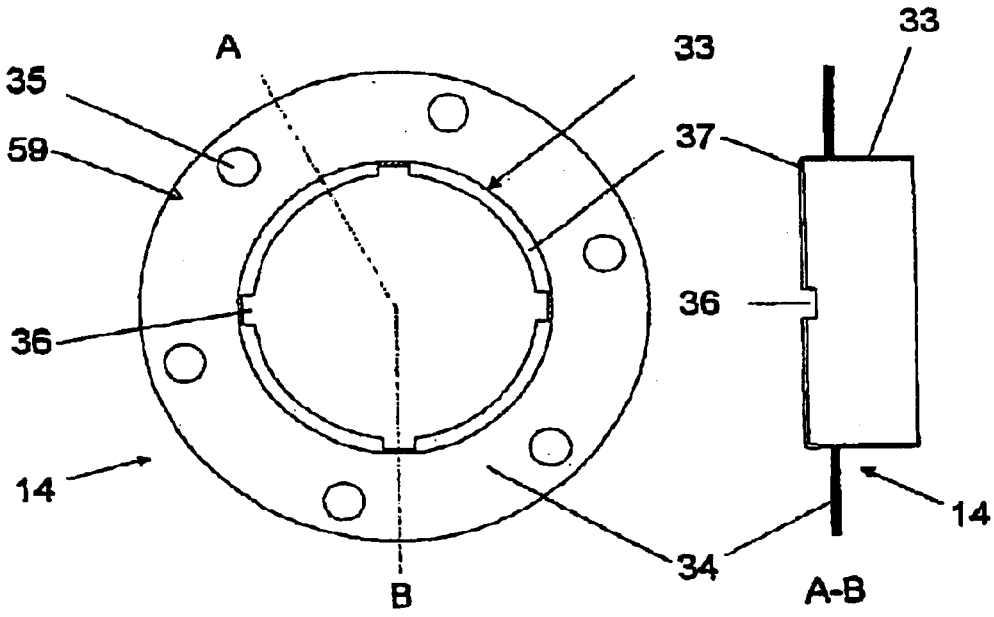

The housing 26 of the heating device 24 is encompassed on the external circumference by the cathode housing 14, the cathode housing being illustrated in more detail in FIG. 4. The cathode housing 14 has an inner cylinder 33, to which a flange 34 is fixed. The flange is a plurality of through-holes 35 which, as described later, serve for alignment via alignment pins. The inner cylinder 33 has four incisions 36, observed across its circumference, which cooperate with the grating holder 17. As can be detected in FIG. 4, the cylinder has an inwardly directed bend 37.

Figure 5:
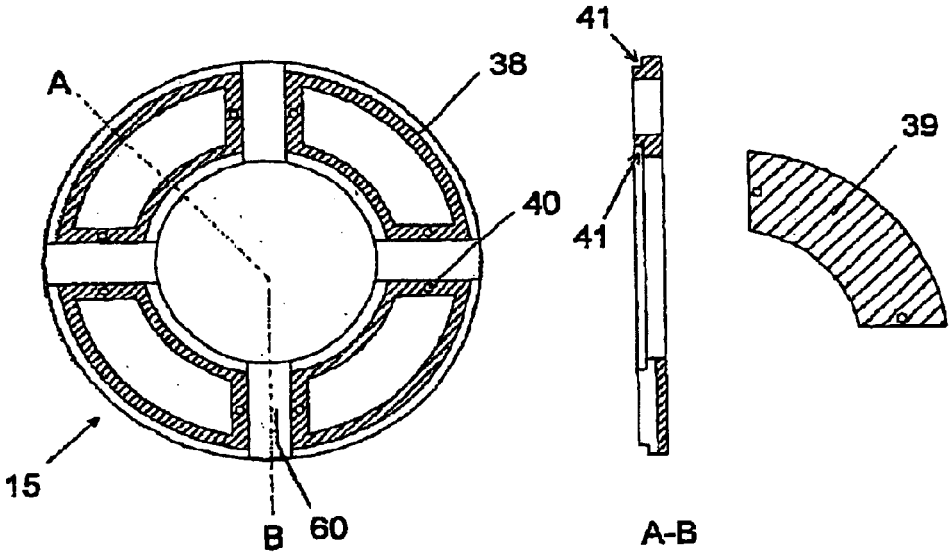

The cathode 15, which is illustrated in FIG. 5, is contained in the cylinder 33 of the cathode housing 14 and has a cathode body 38 and a face 39 which emits electrons or is sensitive. In FIG. 5, the face 39 emitting electrons is configured as annular segment-like plates which can be secured on the cathode body 38 by means of pins 40. The cathode body 38, which is likewise configured annularly, has gradations 41, which serve for fixing with respect to the cathode housing 14, on its inner and outer circumference. For this purpose, the bend 37 engages via the gradation.

The cathode 15 is inserted into the cathode housing 14, the cathode body 38 being supported on the one hand on the cylindrical heating housing 26 and being supported on the other hand by a cylinder 42 which is supported on a gradation of a centrally disposed feedback body 43. The feedback body 43 is a component of the feedback arrangement 19 which is described further on. Furthermore, a cover 44 is connected to the feedback body 43, e.g. by welding, the cover 44 surrounding the cathode body 38 and overlapping the gradation 41 on the inner diameter of the cathode body 38. Between the outer circumference of the cathode body 38 and if necessary the sensitive face 39 and the internal circumference of the cylinder 33, also in the region of the bend 37 of the cathode housing and also the corresponding circumferential faces of the cover 44, a gap or a break is provided so that the cathode can expand when heated by the heating device 24 without said cathode bending. The gap is a buffer for equalising the differences in the thermal expansion coefficient between the cathode housing 14 and the cathode 15. At the bends 37, the cathode housing is connected electrically to the cathode body 38.

Figure 7:
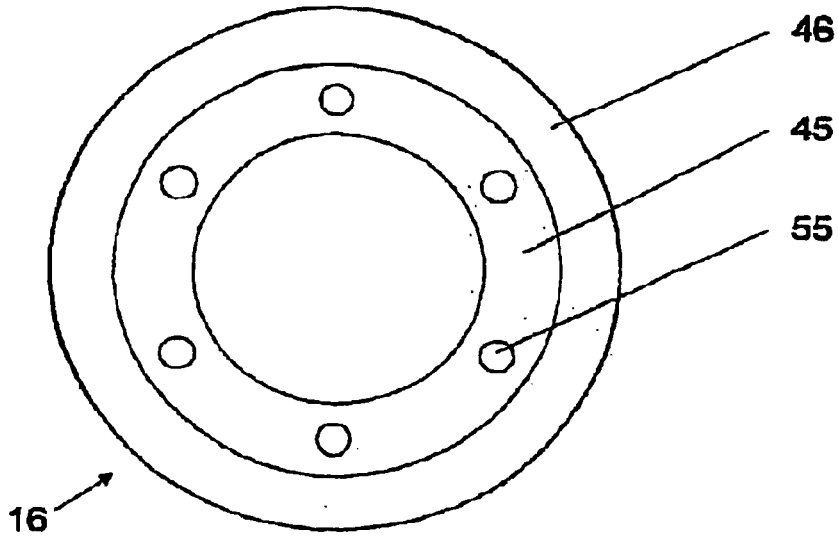
Figure 8:
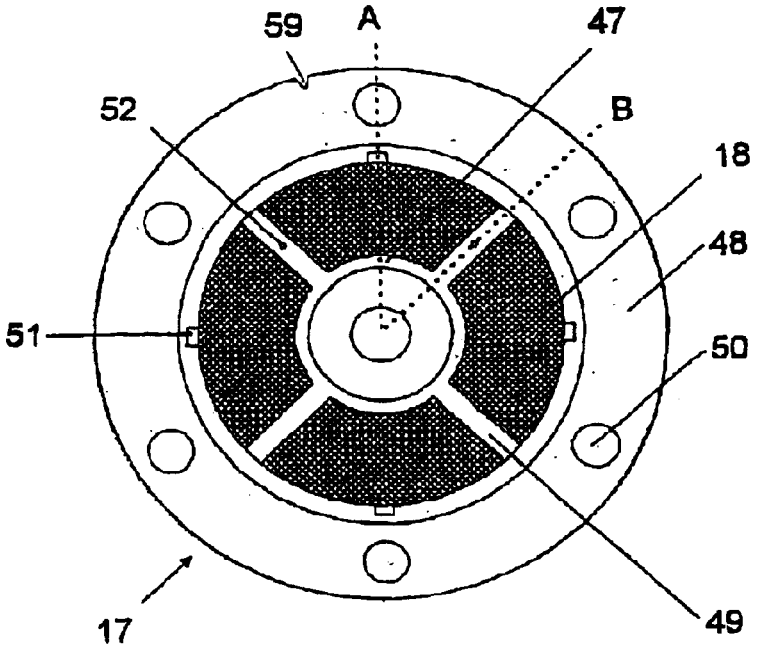
Figure 8:
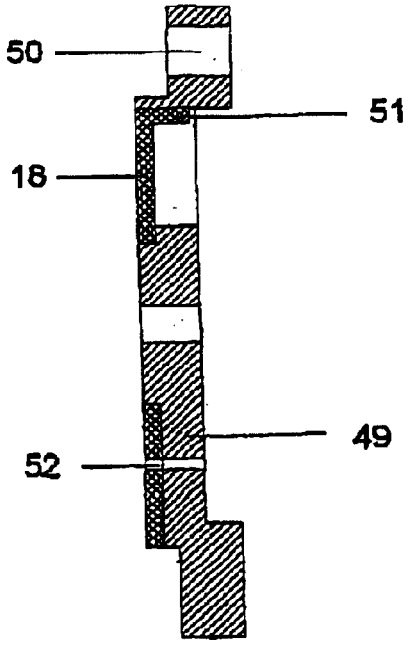

As can be detected in FIGS. 2 and 3, there are located in position one on top of the other on the flange 34 of the cathode housing 14 the annular blocking or coupling element 16, which is illustrated in more detail in FIG. 7, and thereabove the outer edge region of the grating holder 17, which is illustrated in more detail in FIG. 8. The blocking or coupling element 16 is made of a ceramic disc 45, having a central hole and a metal coating 46 around the outer edge and side region, the metal coating 46 having no contact with the cathode housing 14 or with the grating holder 17. Corresponding to the cathode housing 14, the choke element 16 or the ceramic disc 45 has no through-holes 55 for alignment pins.

The grating holder 17 corresponding to FIG. 8 has an inner ring 47 and an outer ring 48 which are connected via four spokes or bridge members 49. The outer ring 48 is provided with a gradation in order to ensure the spacing from the cathode arrangement. Through-holes 50 for the alignment pins are provided in the outer ring 48. The grating 18 with a multiplicity of holes is supported on the grating holder 17, the spokes 49 preventing sagging of the grating 18 at high temperatures of the cathode 15. The spacing between the grating 18 and the cathode 15 lies approximately between 0.1 and 1 mm and the diameter of the cathode and of the grating is approximately 40 mm. The grating 18 is positioned and fixed on the grating holder 17 by four rectangular cut-outs 51 and pins 52.

As can be detected in FIG. 3, alignment pins 53, which are surrounded with an electrically insulating sleeve, e.g. a ceramic sleeve 54, reach through the alignment holes 50 of the grating holder 17, the through-holes 55 of the blocking element 16 and the through-holes 35 of the flange 34 of the cathode housing 14. The alignment pins 53 are screwed in respectively with interposition of a spacing ring 57 and an insulation ring 58. For the alignment of the cathode housing 14 with cathode 15 and of the grating holder 17 with grating 18, notch marks 59 are provided on the circumference of the flange 34 of the cathode housing and of the grating holder 17, with the superimposition of which marks it is ensured that the webs 49 of the grating holder 17 can engage in radial recesses 60 in the cathode body 38 (see FIG. 5) whilst maintaining a spacing for the electrical insulation therebetween. The webs 49 likewise engage in the rectangular incisions 36 of the cathode housing 14 but do not come into electrical contact with the latter due to the precise positioning.

Figure 9:
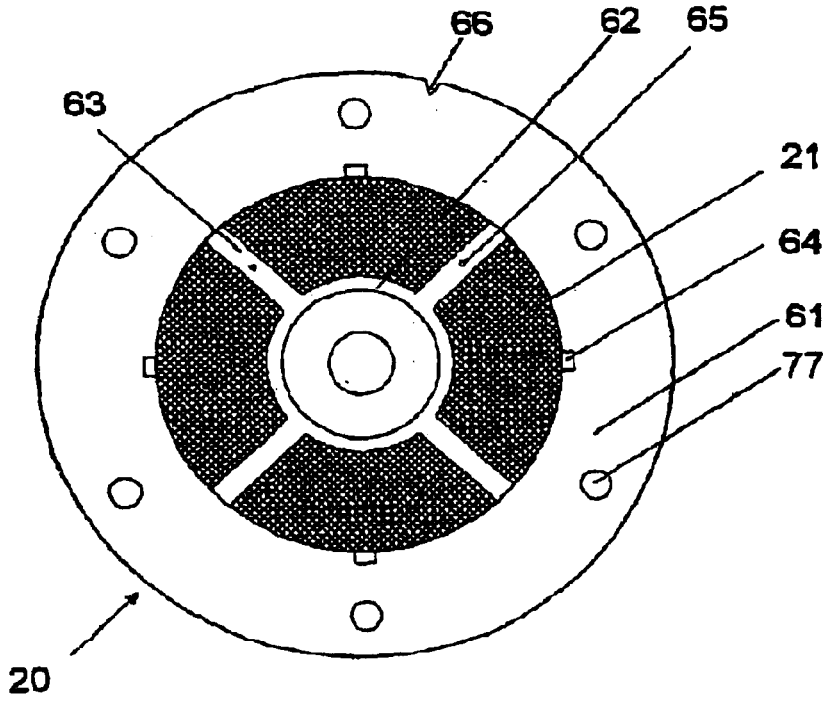

The second grating arrangement, which has the grating holder 20 and the grating 21, is situated above the first grating arrangement. The second grating arrangement, which is illustrated in FIG. 9, is constructed similarly to the first grating arrangement according to FIG. 8 and has an outer ring 61 provided with through-holes 77 and an inner ring 62, the two being connected by spokes 63. The grating 21 is supported on the spokes 63 in order to avoid sagging thereof, and is likewise fixed via rectangular incisions 64 and pins 65. A notch mark 66 serves for positioning with respect to the other components. The alignment pins 53 with the ceramic sleeves also reach through the through-holes 77. The grating holder 20 is connected securely to the anode wall 22 and the alignment pins 53 are connected securely to the grating holder 20.

The ceramic sleeves 54 surrounding the alignment pins 53 serve at the same time as spacing elements between the grating holder 20 and the grating holder 17, as a result of which the output cavity and the input cavity are disposed parallel to each other whilst maintaining a precise spacing.

Figure 10:
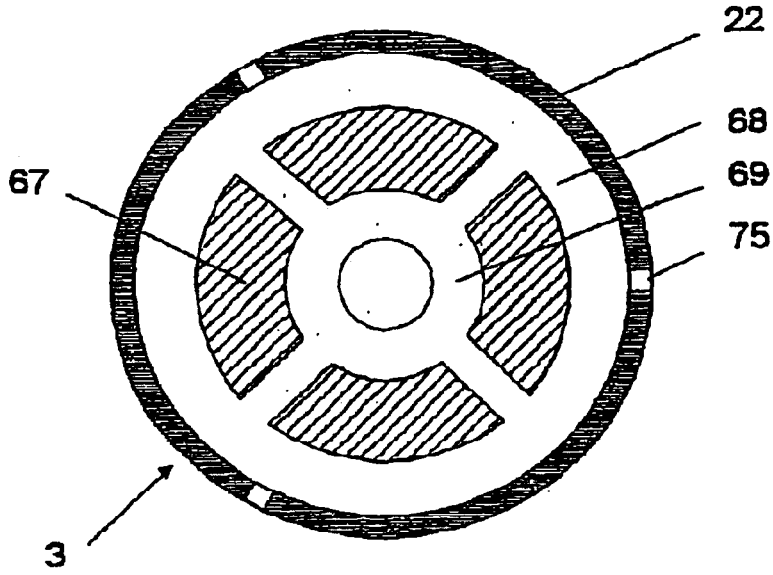

The anode 3 is illustrated in FIG. 10, observed from below. It has four segment-like projections 67, as a result of which an outer annular chamber 68 which represents the output cavity, and an inner annular chamber 69 are formed. In the anode wall surrounding the outer annular chamber 68, three through-holes 75 are provided for the tuning pins 23.

Figure 6:
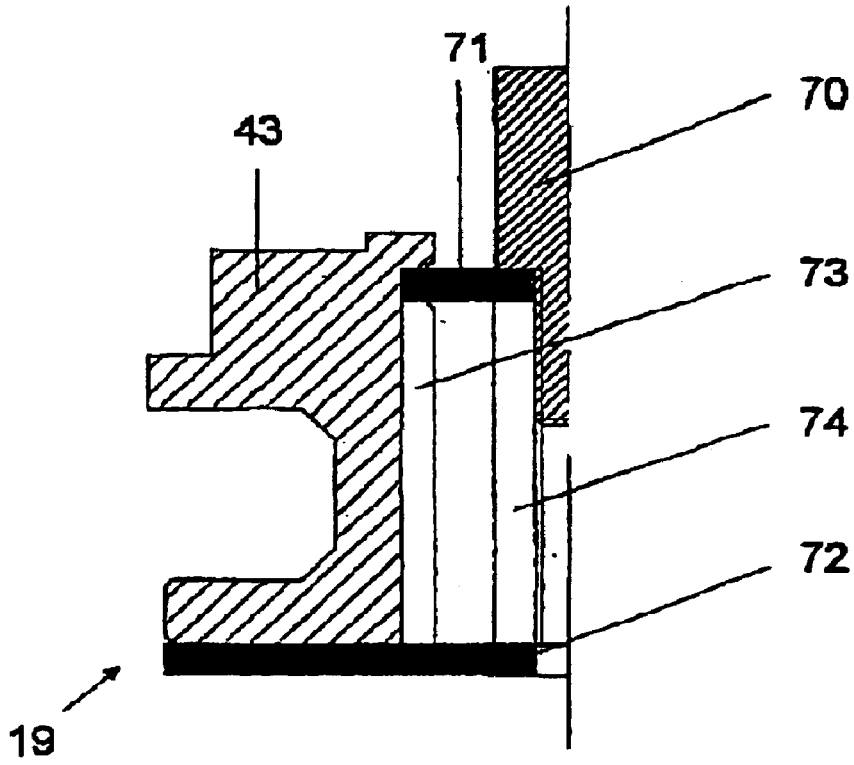

With reference to FIGS. 2, 3 and 6, the feedback arrangement 19 is now described. The feedback arrangement 19 has the centrally disposed feedback body 43, into which a cylinder 73 and a screw sleeve 74 are inserted centrally, all three elements being made preferably from molybdenum. A feedback bar 70 made of copper is screwed into the screw sleeve 74, the feedback bar being supported on a first ceramic disc 71 which is disposed on the end faces of the cylinder 73 and of the screw sleeve 74, a second ceramic disc 72 abutting against the other end faces and the feedback body 43.

As indicated in FIG. 1, earth potential or a positive voltage is applied to the anode and a negative voltage to the cathode housing via the plug 31, a not-illustrated trimming resistor being provided between the grating holder 17 and the cathode housing 14. The trimming resistor leads to a potential block in the grating 18 for electrons, as a result of which the quantity of electrons passing through the holes in the grating 18 is limited. Hence a power control is possible.

The mode of operation of the device is as follows. An initial microwave oscillation is produced in the input cavity 12, this oscillation modulating an electron flow in density. The electron flow 78 (FIG. 3), which is modulated in density, is focused by means of the gratings 18, 21 and accelerated towards the anode 3 by means of the voltage existing between the cathode and anode. The output cavity 13 transforms the kinetic energy of the electrons into microwave energy. A part of the microwave energy is fed back to the input cavity 12. This leads to the fact that the oscillations in the input cavity and in the output cavity are harmonised.

The choke or blocking arrangement 16 has the effect that an initial microwave oscillation is produced in the input cavity 12. When the thermionic cathode 15 is heated by the heating device to a specific operating temperature, e.g. between 800 and 1000° C., it emits electrons. Due to the high voltage, e.g. a direct voltage of 550 V, between the cathode 15 and the anode 3, the electrons flow through the aligned holes in the grating 18 and the grating 21 towards the anode. A small proportion of electrons is trapped by the grating 18, as a result of which a negative potential is formed relative to the cathode 15. A small flow flows on the surface in the input cavity and the flow direction is changed by means of the choke arrangement 16 which induces a weak oscillation. The choke arrangement thereby has the function of blocking a direct current between the grating holder 17 and the cathode housing 14. The negative potential on the grating 18 increases to a stabilised value which is prescribed by the trimming resistor. As a result, the oscillation amplitude is stabilised and an electron flow is modulated in density by the grating 18 due to the oscillation. The negative potential on the grating 18 induces an electrostatic field which focuses the flow of the electrons. The electrons which are modulated in density are accelerated towards the projections 67 of the anode 3 via the grating 18 and the grating 21. In the outer annular chamber 68, the kinetic energy of the electrons in transformed into microwave energy. The coupling element protruding into the inner annular chamber 69 transmits the predominant proportion of microwaves to the antenna 7 which decouples the energy to a not-illustrated waveguide. The feedback bar 70 protruding into the inner annular chamber 69 transmits a part of the microwave energy to the input cavity 12 via the ceramic discs 71, 72, as a result of which a coherence of the oscillations is ensured.

The cathode 15 according to FIG. 5 is a combination of a cathode body 38 with pins 40 and metal plates 39, in which the pins 40 are used in order to align the metal plates relative to the cathode body 38. The cathode body 38 which is produced from metal with a relatively low heat expansion coefficient, serves for reducing the thermal deformation due to the high operating temperatures. If a metal oxide cathode is used, the plates are made of a nickel sheet on which a thick layer of a BaO mixture is deposited.

The thick layer is produced by spraying or screen printing. The operating temperature is approximately 850° C. If a metal alloy cathode is used, the metal plate is an alloy metal, e.g. Pd—Ba, Pt—Ba. This cathode enables the emission of electrons at a relatively low operating temperature (approximately 650° C.) but it is very expensive.

What is claimed is:

1. A device for producing high-frequency microwaves, having a cathode arrangement with heatable cathodes for emitting electrons, two grating arrangements for controlling and focusing the electron flow and an anode for receiving the electrons passing through the grating arrangements, the cathode arrangement and the first grating arrangement defining an input cavity forming a resonance cavity and the anode and the second grating arrangement defining an output cavity likewise forming a resonance cavity, wherein the cathode arrangement and at least the first grating arrangement comprise positioning means for precise fixing and positioning relative to each other while maintaining a spacing, and in that the cathode arrangement has a mounting for receiving the cathode in such a manner that a deformation of the cathode with reduction of the spacing between the cathode and the grating arrangement is avoided.

2. The device according to claim 1, wherein the mounting is configured with respect to the cathode in such a manner that a radial heat expansion is possible without reducing the spacing between the cathode and the grating arrangement.

3. The device according to claim 1, wherein the mounting has a cathode housing containing the cathode, the cathode being disposed at a radial spacing from the housing wall.

4. The device according to claim 3, wherein the mounting has a support face disposed within the cathode housing 14, on which support face the cathode is supported.

5. The device according to claim 1, wherein the cathode has an annular cathode body, on which the face emitting electrons is secured.

6. The device according to claim 5, wherein the face emitting electrons is at least a metal plate applied on the cathode body as a separate part.

7. The device according to claim 1, wherein the grating arrangements have respectively one grating holder and at least one grating filter the grating holders being configured in such a manner that sagging of the gratings during operation is avoided.

8. The device according to claim 7, wherein the respective grating arrangement has an annular grating holder with spoke-shaped webs, the respective grating being supported on the edge and on the webs of the grating holder and being fixed to the latter in a frictional or form fit.

9. The device according to claim 7, wherein an annular blocking or choke element is disposed between the grating holder of the first grating arrangement and the cathode housing.

10. The device according to claim 9, wherein the blocking or choke element is configured as a partly metallically coated ceramic disc.

11. The device according to claim 1, wherein cathode housing, choke element and grating holder of the two grating arrangements are aligned relative to each other by means of alignment pins and are fixed in their position relative to each other, as a result of which the input cavity and the output cavity ate disposed parallel to each other.

12. The device according to claim 1, wherein the two grating arrangements are spaced via electrically insulating spacing elements.

13. The device according to claim 12, wherein the spacing elements are a component of ceramic sleeves which encompass the spacing pins.

14. The device according to claim 1, wherein a feedback arrangement is provided between input and output cavity, which feedback arrangement has a coupling bar reaching through the grating arrangements, said coupling bar being inserted into a feedback body.

15. The device according to claim 1, wherein the cathode housing has a cylinder with attached flange, the cathode and also a heating element being contained within the cylinder.

16. The device according to claim 1, wherein the cathode is made of a metal sheet, preferably a nickel metal sheet with sprayed-on or pressed-on metal oxides, preferably based on barium.

17. The device according to claim 1, wherein the cathode and/or the face emitting electrons is made of a metal sheet made of Pd—Ba or Pt—Ba.

18. The device according to claim 1, wherein the grating holder of the second grating arrangement is connected securely to a circumferential wall of the anode, said wall delimitting the output cavity.

19. The device according to claim 7, wherein cathode housing, choke element and grating holder of the two grating arrangements are aligned relative to each other by means of alignment pins and are fixed in their position relative to each other, as a result of which the input cavity and the output cavity ate disposed parallel to each other.

* * * * *